US007592561B2

(12) United States Patent
Nishiyama et al.

(10) Patent No.: US 7,592,561 B2
(45) Date of Patent: Sep. 22, 2009

(54) ILLUMINATED SWITCH

(75) Inventors: Yoshinori Nishiyama, Miyagi-ken (JP); Ayumu Kobayashi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/118,005

(22) Filed: May 9, 2008

(65) Prior Publication Data

US 2009/0000929 A1 Jan. 1, 2009

(51) Int. Cl.
*H01H 9/00* (2006.01)

(52) U.S. Cl. ..... 200/313; 200/314

(58) Field of Classification Search ..... 200/313
See application file for complete search history.

(56) References Cited

U.S. PATENT DOCUMENTS

| | | | | |
|---|---|---|---|---|
| 5,128,842 | A * | 7/1992 | Kenmochi | 362/95 |
| 5,826,708 | A * | 10/1998 | Finlay | 200/314 |
| 5,988,842 | A * | 11/1999 | Johnsen et al. | 362/551 |
| 7,244,899 | B2 * | 7/2007 | Jung et al. | 200/314 |
| 7,394,034 | B2 * | 7/2008 | Ostendorf et al. | 200/314 |
| 7,423,229 | B2 * | 9/2008 | Chen | 200/314 |
| 2006/0187659 | A1 | 8/2006 | Nawashiro | |

FOREIGN PATENT DOCUMENTS

| | | |
|---|---|---|
| DE | 196 47 218 C1 | 4/1998 |
| JP | 2000-100275 | 4/2000 |
| JP | 2004-87307 | 3/2004 |
| JP | 2006-59561 | 3/2006 |

OTHER PUBLICATIONS

Search Report issued in corresponding European Patent Application No. 08010479.7; mailed Nov. 3, 2008.

* cited by examiner

*Primary Examiner*—Elvin G Enad
*Assistant Examiner*—Lheiren Mae A Anglo
(74) *Attorney, Agent, or Firm*—Brinks Hofer Gilson & Lione

(57) ABSTRACT

An illuminated switch includes an operation knob that includes an operation surface, a light source that emits light beams using a predetermined direction as an optical axis, and a first light guide member that is provided in the operation knob and guides the light beams emitted from the light source to the operation surface. The first light guide member includes a light incident surface formed of inclined surface that refracts light beams entering along the optical axis in a first direction, a reflection surface that reflects light beams refracted at the light incident surface in a second direction different from the first direction, and a light exit surface that transmits light beams reflected by the reflection surface.

7 Claims, 4 Drawing Sheets

ILLUMINATED SWITCH

CROSS REFERENCE TO RELATED APPLICATION

The present invention contains subject matter related to Japanese Patent Application No. 2007-169076 filed in the Japanese Patent Office on Jun. 27, 2007, the entire contents of which being incorporated herein by reference.

BACKGROUND

1. Technical Field

The preset invention relates to an illuminated switch including an illumination mechanism that illuminates a surface (operation surface) of an operation knob from inside.

2. Related Art

A switch device has been disclosed in Japanese Unexamined Patent Application Publication No. 2006-59561. The switch device includes a translucent indicator side guide and a light emitting material side guide, which are disposed to be separated from each other. The translucent indicator side guide is provided in an operation knob, and light beams enter the light emitting material side guide from a luminous body. In the switch device, light beams emitted from the luminous body reach the translucent indicator side guide from the light emitting material side guide, so that a translucent indicator is illuminated.

Further, the invention relating to a switch of electrical equipment for an automobile has been disclosed in FIG. 6 of Japanese Unexamined Patent Application Publication No. 2000-100275. The switch propagates light beams emitted from a light source in a desired direction by disposing a triangular prism at a light emitting end of an optical path member.

However, in the switch device disclosed in Japanese Unexamined Patent Application Publication No. 2006-59561, the directions of the light beams passing though the translucent indicator side guide are different from one another. For this reason, when being emitted from the translucent indicator side guide, light beams are apt to be dispersed in several directions. Therefore, there has been a problem in that the brightness deteriorates when an operator see the translucent indicator.

Meanwhile, Japanese Unexamined Patent Application Publication No. 2000-100275 discloses a technology that solves the above-mentioned problem and propagates light beams emitted from the luminous body in a desired direction. However, there have been problems in that the amount of light is reduced at the peripheral portion of the light exit surface of the light guide member and the unevenness of brightness occurs.

SUMMARY

According to an aspect of the disclosure, an illuminated switch includes an operation knob that includes an operation surface, a light source that emits light beams having an optical axis in a predetermined direction, and a first light guide member that is provided in the operation knob and guides the light beams emitted from the light source to the operation surface. The first light guide member includes a light incident surface formed of inclined surface that refracts light beams entering along the optical axis in a first direction, a reflection surface that reflects light beams refracted at the light incident surface in a second direction different from the first direction, and a light exit surface that transmits light beams reflected by the reflection surface. The light beams emitted from the light source are reflected by the reflection surface, and then exit from the light exit surface. Therefore, it is possible to provide a sufficient amount of light to the peripheral portion of the light exit surface and to prevent the unevenness of brightness of the light exit surface.

DESCRIPTION OF EXEMPLARY EMBODIMENTS

Figure 1:
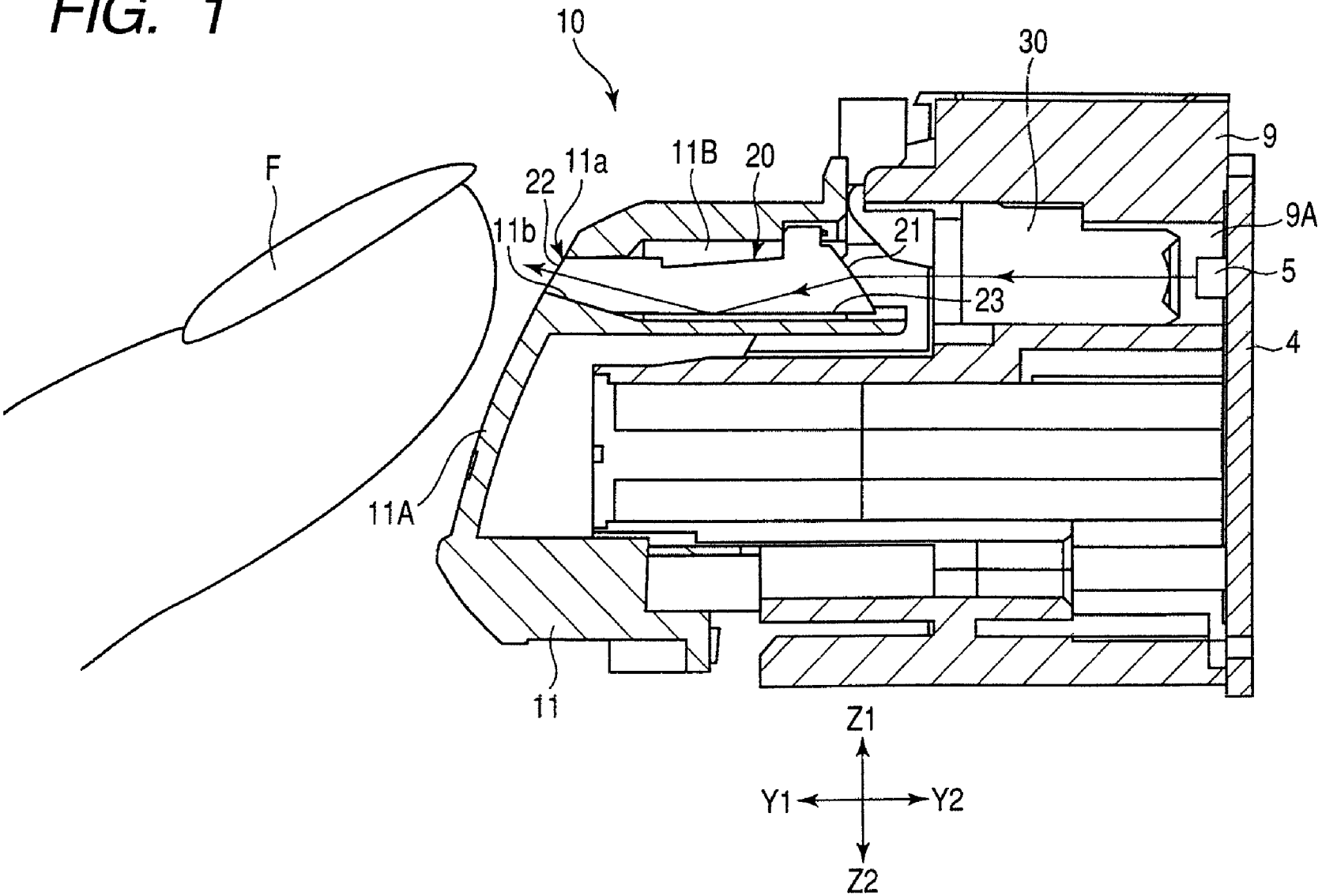
FIG. 1 is a cross-sectional view of an illuminated switch according to an embodiment.
Figure 2:
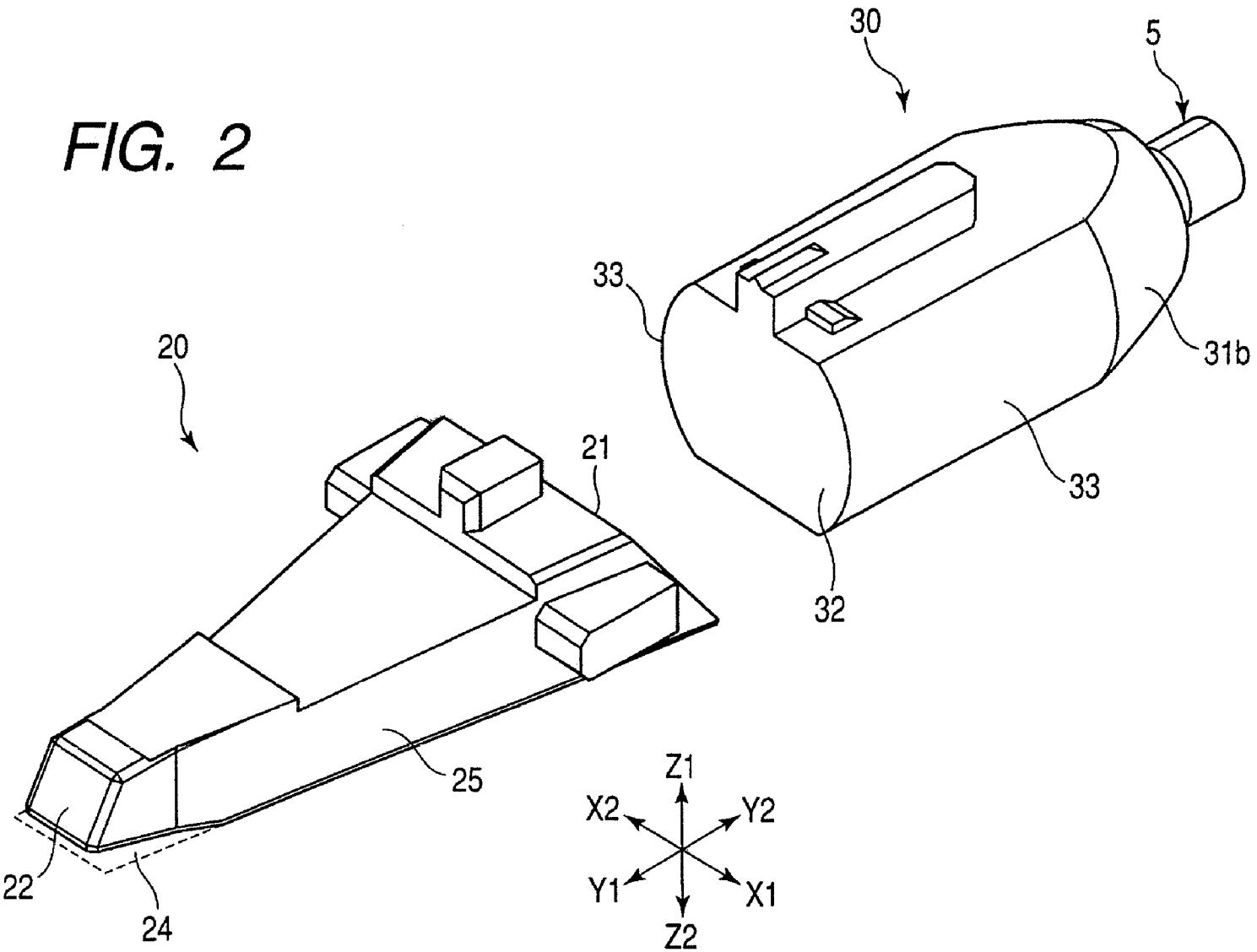
FIG. 2 is a perspective view of a first light guide member and a second light guide member.
Figure 3:
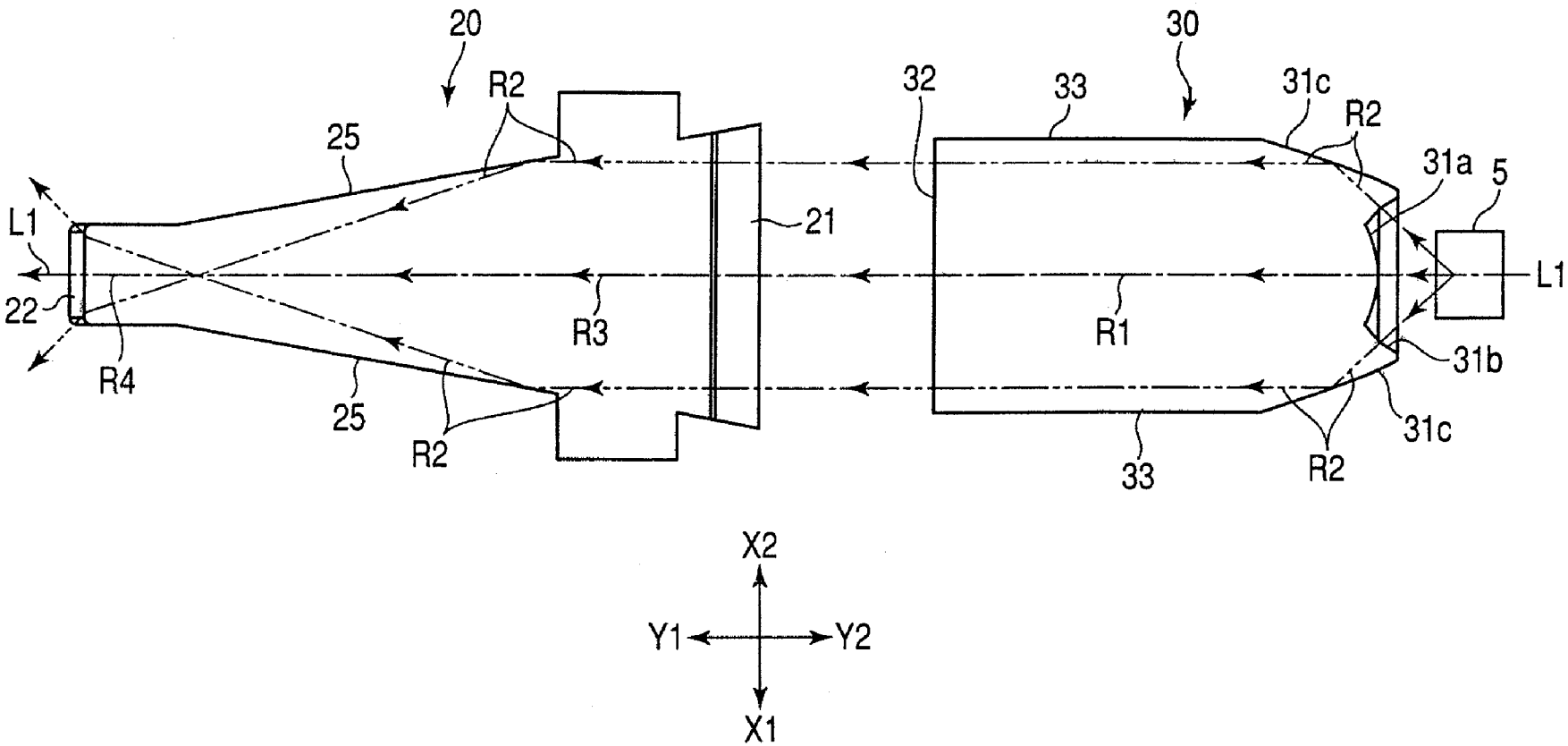
FIG. 3 is a cross-sectional view of the first light guide member and the second light guide member, as seen from above (in a Z2 direction).
Figure 4:
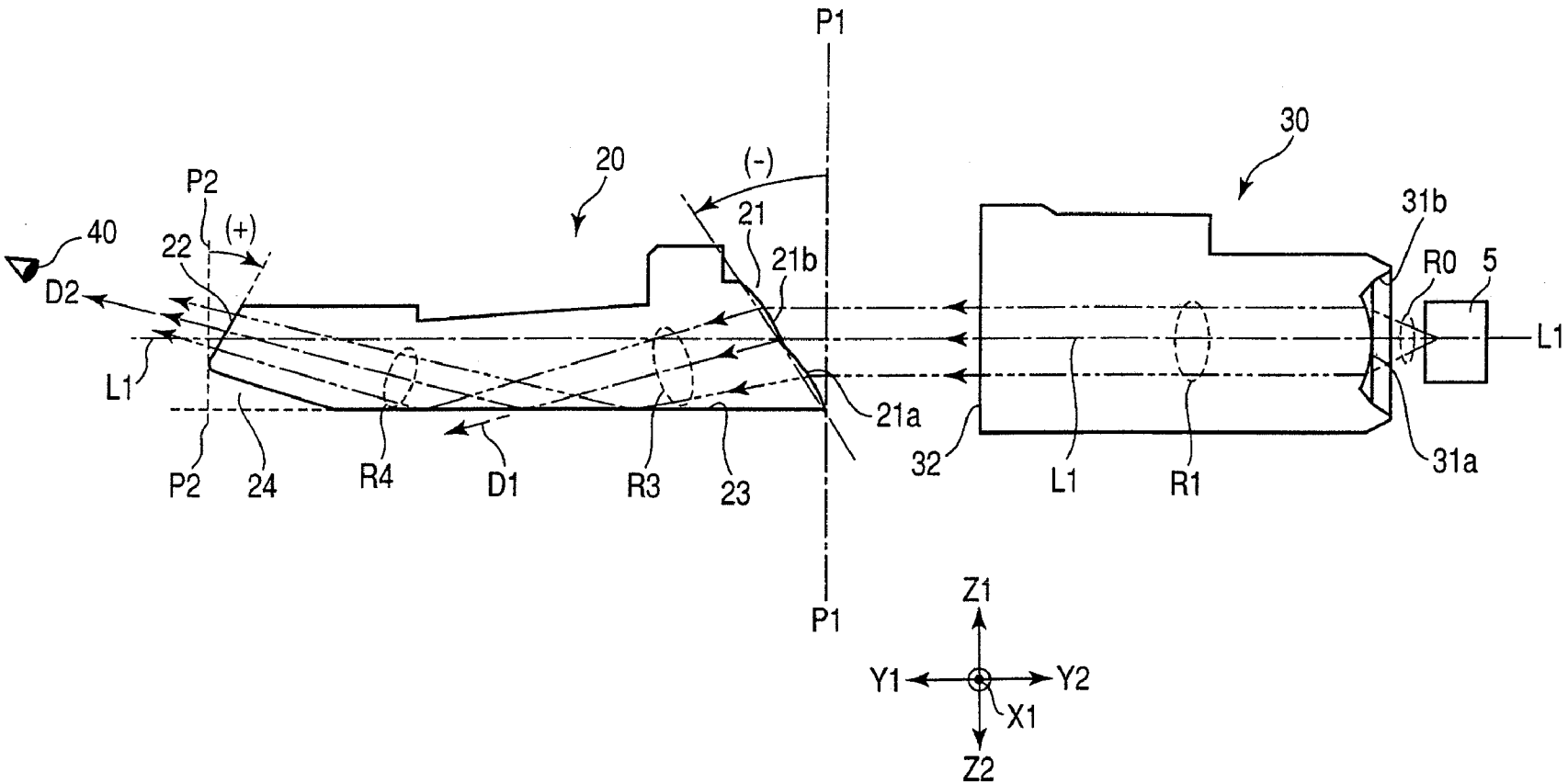
FIG. 4 is a cross-sectional view of the first light guide member and the second light guide member, as seen from the side (in an X2 direction).

FIG. 1 is a cross-sectional view of an illuminated switch according to an embodiment. FIG. 2 is a perspective view of a first light guide member and a second light guide member. FIG. 3 is a cross-sectional view of the first light guide member and the second light guide member, as seen from above (in a Z2 direction). FIG. 4 is a cross-sectional view of the first light guide member and the second light guide member, as seen from the side (in an X2 direction).

Hereinafter, an optical axis, which passes through a light source 5 and is parallel to a Y axis, will be described as an optical axis L1.

An illuminated switch 10 shown in FIG. 1 is an operation switch used, for example, in a vehicle-mounted electronic device (such as an air conditioner), and includes an operation knob 11 that is provided so as to swing with respect to an electronic device body 9. In FIG. 1, a front face of the electronic device is disposed in a Y1 direction, and the Y2 side of the drawing corresponds to a back portion of the electronic device.

The operation knob 11 includes an operation surface 11A that faces toward the front face of the electronic device body 9. An opening 11*a* is formed at a portion of the operation surface 11A. A communication passage 11B continued from the opening 11*a* is formed in the operation knob 11 so as to extend in a Y2 direction. A bottom of the communication passage 11B is parallel to a Y axis. However, the bottom of a front end of the communication passage 11B in the Y1 direction of the drawing is formed of an inclined surface 11*b* that is inclined in a Z1 direction of the drawing toward the front end. A first light guide member 20 is provided in the communication passage 11B of the operation knob 11. A notch 24 to be described below faces the inclined surface 11*b*.

A mounting hole 9A passing through the electronic device body 9 in the Y direction of the drawing is formed at a position facing the communication passage 11B. A second light guide member 30 is provided in the mounting hole 9A.

As shown in FIGS. 2 to 4, the first light guide member 20 is triangular in plan view. The first light guide member 20 includes a light incident surface 21 at the end thereof corresponding to the Y2 side of the drawing, a light exit surface 22 at the end thereof corresponding to the Y1 side, and a reflection surface 23 at the bottom thereof corresponding to the Z2 side.

The light incident surface 21 and the light exit surface 22 are formed of inclined surfaces that are inclined in directions opposite to each other, respectively. That is, as shown in FIG. 4, the light incident surface 21 is formed of an inclined surface that has a negative angle between a plane inclined from top left to bottom right and a first virtual plane P1-P1 perpendicular to the optical axis L1-L1. Likewise, the light exit surface 22 is formed of an inclined surface that has a positive angle between a plane inclined from top right to bottom left and a second virtual plane P2-P2 perpendicular to the optical axis L1-L1. For this reason, the light incident surface 21 can refract incident parallel light beams R1 in a first direction D1 toward the reflection surface 23, and the light exit surface 22 can emit light beams R4 reflected from the reflection surface 23 in a second direction D2 toward an operator. The first virtual plane P1-P1 and the second virtual plane P2-P2 are parallel to a Z-X plane of the drawing.

Meanwhile, the light incident surface 21 may be formed of a cylindrical surface, and, for example, may be formed of cylindrical surfaces 21*a* and 21*b* that are formed in two stages along an inclined surface as shown in FIG. 4. If the light incident surface 21 is formed of a cylindrical surface as described above, it is possible to suppress the spreading of light beams in a height (Z) direction while permitting the spreading of light beams in a width (X) direction. Accordingly, the vehicle-mounted electronic device can be easily seen from both a driver's seat and a passenger seat, so that the light exit surface 22 can have high brightness.

As shown in cross-sectional view of FIG. 3, side surfaces 25 and 25 of the first light guide member 20 are formed in a tapered shape from the light incident surface 21 toward the light exit surface 22. Therefore, an area of the light incident surface 21 is smaller than that of the light exit surface 22.

The reflection surface 23, which is a bottom of the first light guide member 20, is parallel to a horizontal plane (X-Y plane) except for a part thereof. The part of the reflection surface is a notch 24 that is formed by undercutting the front end of the reflection surface 23 of the first light guide member 20 corresponding to the Y1 side of the drawing. Assuming that a light exit surface is formed at a portion corresponding to the notch 24, it is difficult for light beams to reach the front end. Therefore, it is possible to prevent or suppress the unevenness of brightness by cutting the front end. Meanwhile, an area of the reflection surface 23 is larger than that of the light exit surface 22.

A collimating part 31 is formed at an end face of the second light guide member 30, which corresponds to the Y1 side of the drawing and is an incident side, and a light emitting surface 32 is formed at an end face of the second light guide member corresponds to the Y2 side of the drawing.

The collimating part 31 includes a convex lens portion 31*a*, a light receiving surface 31*b* that becomes broad from the edge of the convex lens portion 31*a* toward the outside in the shape of a megaphone, and conical surfaces 31*c*. Meanwhile, the center of the collimating part 31 is disposed on the optical axis L1-L1 that passes through the center of the light source 5 and is parallel to the Y axis, and the light emitting surface 32 is a surface that is perpendicular to the optical axis L1-L1.

As shown in FIG. 2, side surfaces of the second light guide member 30 in the X1 and X2 directions are formed of cylindrical surfaces 33 and 33. The conical surfaces 31*c* and 31*c*, which are gradually tapered toward the front ends thereof in the Y2 direction, are continuously formed at the ends of the cylindrical surfaces 33 and 33 corresponding to the Y2 side of the drawing.

Each of the first and second light guide members 20 and 30 is integrally made of, for example, a transparent resin material such as an acrylic resin.

As shown in FIG. 1, while the first light guide member 20 is disposed in the communication passage 11B, the operation knob 11 is swingably supported by the electronic device body 9. In this case, the light exit surface 22 of the first light guide member 20 is seen through the opening 11*a* of the operation surface 11A. Further, the operation surface 11A of the operation knob 11 and the light exit surface 22 of the first light guide member 20 are perpendicular to the second direction D2. In addition, the operation knob and the first light guide member are provided so that the operation surface is flush with the light exit surface.

A substrate 4 is fixed to the end of the electronic device body 9 corresponding to the Y2 side. The light source 5 is fixed to a surface of the substrate 4 corresponding to the Y1 side. Accordingly, when the substrate 4 is fixed to the end of the electronic device body 9 corresponding to the Y2 side, the light source 5 is disposed at the end of the mounting hole 9A. Meanwhile, the light source 5 is composed of, for example, an LED or the like.

As shown in FIGS. 2 to 4, if the first light guide member 20, the second light guide member 30, and the light source 5 are separated and shown, the members and the source are disposed on the optical axis L1-L1 that passes through the center of the light source 5 and is parallel to the Y axis. That is, the light source 5 is provided on the Y2 side of the drawing, and the first light guide member 20 is provided on the Y1 side of the drawing. Further, the second light guide member 30 is disposed between the light source 5 and the first light guide member 20. The collimating part 31 of the second light guide member 30 is disposed near the light source 5 so as to face the light source, and the light emitting surface 32 of the second light guide member 30 is disposed to face the light incident surface 21 of the first light guide member 20.

When the operation surface 11A is operated by a finger F, the operation knob 11 swings and a switch mechanism (not shown) is thus switched to ON/OFF. For example, the light source 5 is set to be turned on when the switch mechanism is switched to ON, and to be turned off when the switch mechanism is switched to OFF. Accordingly, the light exit surface 22 seen on the operation surface 11A is turned on and off.

The illuminating operation of the illuminated switch having the above-mentioned structure will be described.

As shown in FIGS. 3 and 4, light beams R0 emitted from the light source 5 enter the second light guide member 30 through the convex lens portion 31*a*, and are directed toward the light emitting surface 32 in the Y1 direction of the drawing. In this case, the light beams R0 are converted into parallel light beams R1 by the convex lens portion 31*a*. The parallel light beams R1 are light beams parallel to the optical axis L1-L1.

Meanwhile, among the light beams R0 emitted from the light source 5, a part of light beams spreading in the width (X1 and X2) direction of FIG. 3 enter from the light receiving surface 31*b* other than the convex lens portion 31*a*. However, the light beams R2 and R2 are reflected by the conical surfaces 31*c* and 31*c*, and are directed toward the light emitting surface 32 in the Y1 direction of the drawing.

The parallel light beams R1 are propagated through the second light guide member 30, and are emitted to the first light guide member 20 through the light emitting surface 32 that is perpendicular to the optical axis L1-L1.

The parallel light beams R1 emitted from the second light guide member 30 enter the first light guide member 20 from the light incident surface 21 of the first light guide member 20.

In this case, the parallel light beams R1 are refracted in the first direction D1 at the light incident surface 21. Further, an angle of refraction in this case is determined by the relationship between a ratio between a refractive index of air and a refractive index of a material of the second light guide member, and an incident angle when the parallel light beams R1 enter the light incident surface 21.

As shown in FIG. 4, light beams R3 refracted at the light incident surface 21 are propagated through the first light guide member 20, reach the reflection surface 23 formed on the bottom of the first light guide member, and are totally reflected by the reflection surface 23. In addition, reflected light beams R4 are propagated through the first light guide member 20 in the second direction D2, and reach the light exit surface 22 provided on the Y1 side of the drawing. Since the area of the reflection surface 23 is larger than that of the light exit surface 22, it is possible to provide a sufficient amount of light to the peripheral portion of the light exit surface 22 as compared to when the light beams R3 are directed to the light exit surface 22 without being reflected, and to reduce the unevenness of brightness.

In this case, as shown in FIG. 4, the second direction D2 where the light, beams R4 are emitted from the light exit surface 22 is perpendicular to the light exit surface 22 and the operation surface 11A. In addition, the light exit surface 22 is set so that an eye 40 of an operator is positioned near an extension line of the second direction D2 in a vertical direction. For this reason, the light exit surface 22 provided on the operation surface 11A faces the operator. Therefore, an operator can easily see the light exit surface.

As shown in cross-sectional view of FIG. 3, the side surfaces 25 and 25 of the first light guide member 20 are formed in a gradually tapered shape from the light incident surface 21 toward the light exit surface 22. For this reason, the parallel light beams R1 entering the first light guide member 20 enter the side surfaces 25 and 25 at an angle that is equal to or larger than a critical angle. Therefore, it is possible to focus the light beams, which enter the first light guide member 20, on the light exit surface 22. As a result, the light exit surface 22 of the first light guide member 20 is sufficiently illuminated.

As shown in FIG. 3, the light beams R2 and R2 reflected by the conical surfaces 31*c* and 31*c* of the second light guide member 30 are totally reflected by the side surfaces 25 and 25, and are directed to the light exit surface 22 of the first light guide member 20. In this case, the light beams R2 and R2 cross each other one time, and then reach both ends of the light emitting surface 32 in the width direction (X direction). Further, when being emitted from the light exit surface 22, the light beams R2 and R2 are refracted so as to be spread in the width direction (X1 and X2 directions). For this reason, even though an eye 40 of an operator is not positioned on an extension line of the second direction D2, the operator can perceive that the light exit surface 22 of the first light guide member 20 is sufficiently illuminated. Therefore, when the illuminated switch 10 is mounted on an instrument panel between a driver's seat and a passenger seat as a vehicle-mounted electronic device, it is possible to perceive that the light exit surface 22 of the first light guide member 20 seen on the operation surface 11A of the illuminated switch 10 is sufficiently illuminated, from the driver's seat and the passenger seat that are not positioned on the extension line of the second direction D2 in a horizontal direction.

As described above, in the illuminated switch according to the embodiment of the invention, it is possible to direct the light beams, which are emitted from the light source 5, in the second direction D2 in a vertical direction, and to prevent the unevenness of brightness of the light exit surface 22. In addition, since the light exit surface 22 of the first light guide member 20 from which light beams are emitted is provided to face an operator in the vertical direction, the light exit surface 22 can be sufficiently bright and easily seen from of an operator's side.

In the above-mentioned embodiment, the light beams emitted from the light source 5 have been converted into parallel light beams by the collimating part 31 of the second light guide member 30, and have then entered the light incident surface 21 of the first light guide member 20. However, the invention is not necessarily limited thereto. That is, if the light source 5 is a laser light source capable of emitting parallel light beams, the second light guide member 30 may be not used and the light beams emitted from the light source 5 may directly enter the light incident surface 21 of the first light guide member 20.

Further, in the above-mentioned embodiment, the operation knob 11 has been swingably supported by the electronic device body 9. However, the invention is not limited thereto, and the operation knob may be swingably mounted on a member forming a switch mechanism such as a switch case or may be mounted on the electronic device body 9 as a switch mechanism.

It should be understood by those skilled in the art that various modifications, combinations, sub-combinations and alterations may occur depending on design requirements and other factors insofar as they are within the scope of the appended claims of the equivalents thereof.

What is claimed is:

1. An illuminated switch comprising:

an operation knob that includes an operation surface;

a light source that emits light beams having an optical axis in a predetermined direction;

a first light guide member that is provided in the operation knob and guides the light beams emitted from the light source to the operation surface; and a second light guide member, which is provided between the light source and a light incident surface, and converts the light beams emitted from the light source into parallel light beams, wherein the first light guide member includes the light incident surface at one end of the first light guide member formed of inclined surface that refracts light beams entering along the optical axis in a first direction, a reflection surface that reflects light beams refracted at the light incident surface in a second direction different from the first direction, and a light exit surface at the other end of the first light guide member that transmits light beams reflected by the reflection surface, wherein the second light guide member includes a convex lens portion at one end thereof facing the light source, and a light emitting surface perpendicular to the optical axis at the other end thereof facing the light incident surface of the first light guide member, and wherein conical surfaces are formed on side surfaces of the second light guide member, and reflect light beams entering from one end of the second light guide member through a light receiving surface, which becomes broad from the edge of the convex lens portion, toward the light emitting surface.

2. The illuminated switch according to claim 1, wherein the light exit surface is formed of an inclined surface that is inclined in a direction opposite to the direction of the light incident surface.

3. The illuminated switch according to claim 2, wherein the operation surface and the light exit surface are parallel to each other.

4. The illuminated switch according to claim 1, wherein the operation knob is movably provided in a device body, the light source and the second light guide member are provided in the device body, and the first light guide member is provided in the operation knob.

5. The illuminated switch according to claim 1, wherein a notch cut along the second direction is formed on the bottom of the first light guide member adjacent to the light exit surface.

6. The illuminated switch according to claim 1, wherein both side surfaces of the first light guide member are formed in a gradually tapered shape from the light incident surface toward the light exit surface, as seen in a plane in which the reflection surface is the bottom.

7. An illuminated switch comprising:

an operation knob that includes an operation surface;

a light source that emits light beams having an optical axis in a predetermined direction;

a first light guide member that is provided in the operation knob and guides the light beams emitted from the light source to the operation surface; and a second light guide member, which is provided between the light source and a light incident surface, and directs the light beams emitted from the light source to the light incident surface, wherein the first light guide member includes the light incident surface at one end of the first light guide member formed of inclined surface that refracts light beams entering along the optical axis in a first direction, a reflection surface that reflects light beams refracted at the light incident surface in a second direction different from the first direction, and a light exit surface at the other end of the first light guide member that transmits light beams reflected by the reflection surface, wherein the second light guide member includes a convex lens portion at one end thereof facing the light source, and a light emitting surface perpendicular to the optical axis at the other end thereof facing the light incident surface of the first light guide member, and wherein conical surfaces are formed on side surfaces of the second light guide member, and reflect light beams entering from one end of the second light guide member through a light receiving surface, which becomes broad from the edge of the convex lens portion, toward the light emitting surface.

* * * * *